US011193659B2

(12) United States Patent
He

(10) Patent No.: US 11,193,659 B2
(45) Date of Patent: Dec. 7, 2021

(54) POINT-CONTROL COPPER WIRE LAMP AND LAMP

(71) Applicant: SHANGYOU JIAYI LIGHTING PRODUCT CO., LTD., Ganzhou (CN)

(72) Inventor: Yaowen He, Ganzhou (CN)

(73) Assignee: SHANGYOU JIAYI LIGHTING PRODUCT CO., LTD., Jiangxi (CN)

( * ) Notice: Subject to any disclaimer, the term of this patent is extended or adjusted under 35 U.S.C. 154(b) by 0 days.

(21) Appl. No.: 17/194,962

(22) Filed: Mar. 8, 2021

(65) Prior Publication Data

US 2021/0278068 A1 Sep. 9, 2021

(30) Foreign Application Priority Data

Mar. 9, 2020 (CN) ..... 202020281712.6

(51) Int. Cl.
*F21V 23/00* (2015.01)
*F21S 4/28* (2016.01)

(52) U.S. Cl.
CPC ..... *F21V 23/002* (2013.01); *F21S 4/28* (2016.01); *F21V 23/004* (2013.01)

(58) Field of Classification Search
CPC ..... F21S 4/20; F21S 4/10; F21V 19/0025; F21V 23/001; H01L 33/36; H01L 33/62
See application file for complete search history.

(56) References Cited

U.S. PATENT DOCUMENTS 10,033,141 B2 * 7/2018 Creusen ..... F21V 23/06
2003/0057886 A1 * 3/2003 Lys ..... F21S 4/10 315/291
2005/0117339 A1 * 6/2005 Pan ..... F21S 4/10 362/249.01
2006/0221609 A1 * 10/2006 Ryan, Jr. ..... F21S 4/20 362/238
2010/0157598 A1 * 6/2010 Tsai ..... F21V 21/002 362/249.01
2012/0039070 A1 * 2/2012 Shen ..... F21S 4/10 362/103
2017/0257924 A1 * 9/2017 Leung ..... F21S 4/10
2019/0078767 A1 * 3/2019 Loomis ..... H05B 47/19

* cited by examiner

*Primary Examiner* — Leah Simone Macchiarolo
(74) *Attorney, Agent, or Firm* — Perry + Currier Inc.

(57) ABSTRACT

The present disclosure provides a point-control copper wire lamp and a lamp, comprising: a plurality of lamp beads, a first connecting line, a signal line and a second connecting line. A lamp bead includes a positive electrode welding leg, a negative electrode welding leg and a signal line welding leg; the positive electrode welding leg is welded to the first connecting line, the negative electrode welding leg is welded to the second connecting line, the signal line welding leg is welded to the signal line, and the lamp beads are arranged sequentially according to the preset positions. The point-control copper wire lamp and the lamp provided by the present disclosure have simple structures, and the lamp beads work independently and do not affect each other.

17 Claims, 2 Drawing Sheets

POINT-CONTROL COPPER WIRE LAMP AND LAMP

CROSS-REFERENCE TO RELATED APPLICATIONS

The present disclosure claims priority to Chinese Patent Application No. 2020202817126 filed with the Chinese Patent Office on Mar. 9, 2020, entitled "Point-Control Copper Wire Lamp and Lamp", which is incorporated herein by reference in its entirety.

FIELD OF THE INVENTION

Technical Field

The present disclosure relates to the technical field of decoration, in particular to a point-control copper wire lamp and a lamp.

Background of the Invention

Currently, in a copper wire point-control technology, a lamp bead comprises a positive electrode welding leg, a negative electrode welding leg, a signal input welding leg and a signal output welding leg. FIGS. 1 and 2 illustrate the structure of a point-control copper wire lamp in the prior art, wherein the positive electrode welding leg of the lamp bead in the prior art is connected to the connecting line thereon, and the negative electrode welding leg is connected to the connecting line there-under, wherein the wire in the middle is a signal line. The signal line needs to firstly go through the IC (Integrated Circuit) chip inside the lamp bead, and the IC chip is connected with the signal input welding leg and the signal output welding leg via the signal line. When the IC chip outputs signals, the signal line in the middle needs to be disconnected, so as to ensure the normal working of the lamp bead and transmit the signals to next lamp bead.

The inventor found in research that traditional point-control copper wire lamps have at least the following defects: when the signal line between the lamp beads is disconnected, or the signal input welding leg or the signal output welding leg of the lamp bead are not in good welding contact with the signal line, the following lamp bead will not receive any signal and thus cannot work. In addition, if one of the lamp beads fails, the following lamp beads cannot work, either.

SUMMARY OF THE INVENTION

The embodiment of the present disclose provides a point-control copper wire lamp that comprises a plurality of lamp beads, a first connecting line, a signal line and a second connecting line, wherein a lamp bead comprises a positive electrode welding leg, a negative electrode welding leg and a signal line welding leg, wherein the positive electrode welding leg is welded to the first connecting line, the negative electrode welding leg is welded to the second connecting line, the signal line welding leg is welded to the signal line, and the lamp beads are arranged sequentially according to preset positions.

The embodiment of the present disclosure also provides a lamp, which comprises the above point-control copper wire lamp.

BRIEF DESCRIPTION OF THE DRAWINGS

In order to more clearly illustrate the embodiments of the present disclosure or technical solutions of the prior art, accompanying drawings which need to be used in the embodiments or the prior art will be introduced briefly below, and obviously, the accompanying drawings below merely show some embodiments of the present disclosure, and therefore, those ordinarily skilled in the art still could obtain other relevant drawings according to these accompanying drawings, without using any inventive effort.

REFERENCE SIGNS

Figure 1:
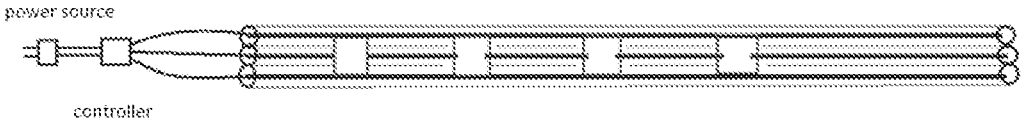
FIG. 1 is a schematic view of the structure of the lamp bead in the prior art.

100—point-control copper wire lamp; 110—lamp bead; 111—positive electrode welding leg; 112—negative electrode welding leg; 113—signal line welding leg; 114—selected lamp bead; 115—unselected lamp bead; 116—first lamp bead; 117—second lamp bead; 121—first connecting line; 122—signal line; 123—second connecting line; 130—power source; 140—controller.

DETAILED DESCRIPTION OF THE EMBODIMENTS

In order to make objects, technical solutions and advantages of the embodiments of the present disclosure clearer, the technical solutions in the present disclosure will be described below clearly and completely in conjunction with accompanying drawings in the embodiments of the present disclosure. Obviously, the described embodiments are only a part of the embodiments of the present disclosure instead of all the embodiments. Based on the embodiments of the present disclosure, all the other embodiments obtained by a person skilled in the art without spending any inventive work belong to the protection scope of the present application.

The present disclosure provides a point-control copper wire lamp and a lamp, which improve the insufficiency of the prior art and have simple structures, and all the lamp beads work independently and do not influence one another.

The embodiment of the present disclosure can be achieved as follows:

the embodiment of the present disclose provides a point-control copper wire lamp that comprises a plurality of lamp beads, a first connecting line, a signal line and a second connecting line, wherein a lamp bead comprises a positive electrode welding leg, a negative electrode welding leg and a signal line welding leg, wherein the positive electrode welding leg is welded to the first connecting line, the negative electrode welding leg is welded to the second connecting line, the signal line welding leg is welded to the signal line, and the lamp beads are arranged sequentially according to preset positions.

Optionally, the point-control copper wire lamp also comprises an IC chip, wherein the IC chip is packaged within the lamp beads, and the IC chip is connected with the signal line via the signal line welding leg.

Optionally, the point-control copper wire lamp also comprises a controller; and the controller is connected with the lamp beads, and the controller is configured to send control instructions to the IC chip in the lamp beads, so that the IC chip executes corresponding operations according to the control instructions.

Optionally, the controller is electrically connected with the signal line, so as to send the control instructions to the IC chip in the lamp beads via the signal line.

Optionally, both the first connecting line and the second connecting line are connected with the controller.

Optionally, the point-control copper wire lamp also comprises a power source, wherein the power source is connected with the controller.

Optionally, the power source is located at the front end of the controller, and the lamp beads are located at the rear end of the controller.

Optionally, the control instructions comprise flash instructions; and the controller is configured to send the flash instructions to the IC chip, so that the IC chip controls the lamp beads to flash according to the flash instructions.

Optionally, the control instructions comprise color display instructions; and the controller is configured to send the color display instructions to the IC chip, so that the IC chip controls the lamp beads to display corresponding colors according to the color display instructions.

Optionally, the controller is configured to select the lamp beads according to the image to be displayed, and control the corresponding lamp beads to flash according to the serial numbers of the selected beads.

Optionally, each of the lamp beads is distributed at a corresponding preset position through a burner.

Optionally, both the first connecting line and the second connecting line are copper wires.

Optionally, the first connecting line, the second connecting line and the signal line are arranged sequentially.

Optionally, the first connecting line, the second connecting line and the signal line are arranged to the lamp beads at an equal interval.

Optionally, the plurality of lamp beads are arranged sequentially at an interval along the extending direction of the signal line.

Optionally, the model of the lamp bead is 4040.

Optionally, the model of the lamp bead is 5028.

Optionally, the model of the lamp bead is 5050 or 5640.

The embodiment of the present disclosure also provides a lamp, which comprises the above point-control copper wire lamp.

Compared with the prior art, the embodiment of the present disclosure has the following advantageous effects, for example:

the embodiment of the present disclosure provides a point-control copper wire lamp and a lamp, comprising: a plurality of lamp beads, a first connecting line, a signal line and a second connecting line, wherein a lamp bead comprises a positive electrode welding leg, a negative electrode welding leg and a signal line welding leg; the positive electrode welding leg is welded to the first connecting line, the negative electrode welding leg is welded to the second connecting line, the signal line welding leg is welded to the signal line, and the lamp beads are arranged sequentially according to the preset positions. The point-control copper wire lamp and the lamp provided by the present disclosure have simple structures, and the lamp beads work independently and do not affect each other.

Other features and advantages of the present disclosure will be described in the description hereafter, and will partially be obvious in the description, or understood by implementing the present disclosure. The purpose and other advantages of the present disclosure are realized and obtained in the structures specially pointed in the description, the claims and the accompanying drawings.

Figure 2:
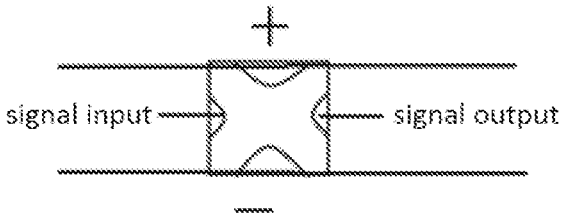
FIG. 2 is a schematic view of the signal output from an IC chip in the prior art.

Referring to FIGS. 1 and 2, currently, in the copper wire point-control technology, a lamp bead comprises a positive electrode welding leg, a negative electrode welding leg, a signal input welding leg and signal output welding leg. The positive electrode welding leg is connected to the connecting line thereon, and the negative electrode welding leg is connected to the connecting line there-under, wherein the wire in the middle is a signal line.

The signal line needs to firstly go through the IC chip inside the lamp bead, and the IC chip is connected with the signal input welding leg and the signal output welding leg via the signal line. When the IC chip outputs signals, the signal line in the middle needs to be disconnected, so as to ensure the normal working of the lamp bead and transmit the signals to next lamp bead.

When the signal line between the lamp beads is disconnected, or the signal input welding leg and the signal output welding leg of a lamp bead are not in good welding contact with the signal line, the following lamp bead will not receive any signal and thus cannot work. In addition, if one of the lamp beads fails, the following lamp beads cannot work, either.

In order to conveniently understand the present embodiment, a detailed introduction of the embodiment of the present disclosure is provided hereafter.

Figure 3:
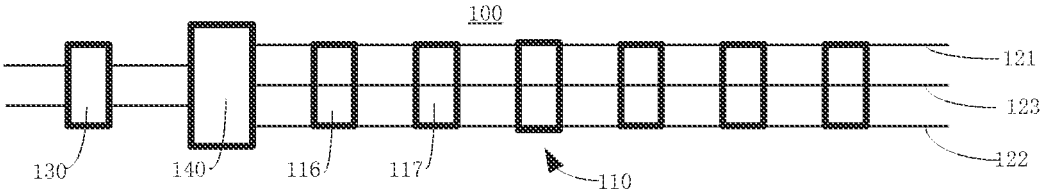
FIG. 3 is a schematic view of the structure of a point-control copper wire lamp provided in an embodiment of the present disclosure.
Figure 4:
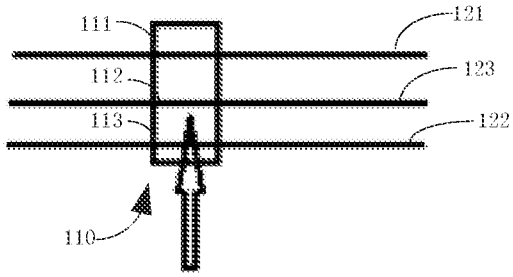
FIG. 4 is a schematic view of the connecting structure of the lamp beads provided in the embodiment of the present disclosure.

FIG. 3 is a schematic view of the structure of a point-control copper wire lamp 100 provided in an embodiment of the present disclosure. FIG. 4 is a schematic view of the connecting structure of the lamp beads 110 provided in the embodiment of the present disclosure.

Referring to FIGS. 3 and 4, the point-control copper wire lamp 100 comprises a plurality of lamp beads 110, a first connecting line 121, a signal line 122 and a second connecting line 123. The lamp bead 110 comprises a positive electrode welding leg 111, a negative electrode welding leg 112 and a signal line welding leg 113.

The positive electrode welding leg 111 of the lamp bead 110 is welded and fixed to the first connecting line 121, the negative electrode welding leg 112 is welded and fixed to the second connecting line 123, the signal line welding leg 113 is welded and fixed to the signal line 122, and the plurality of lamp beads 110 are arranged sequentially according to preset positions. The preset positions are disposed by the distribution of a burner (not shown in the drawings), i.e., each lamp bead 110 is distributed at a corresponding preset position by the burner.

Specifically, the burner scans a first lamp bead 116, and distributes a first address to the first lamp bead 116; then the burner scans a second lamp bead 117 and distributes a second address to the second lamp bead 117; and finally it scans all the lamp beads 110 and distributes corresponding addresses to the scanned lamp beads 110, and then these lamp beads 110 are arranged in the distributed addresses according to the scanning sequence and then the lamp beads 110 are connected sequentially in series. When one of the lamp beads 110 fails, it will not affect other lamp beads 110, and each lamp bead 110 is operated independently.

The lamp bead 110 provided by the embodiment of the present disclosure comprises three welding legs, i.e., the positive electrode welding leg 111, the negative electrode welding leg 112 and the signal line welding leg 113. However, the lamp bead in the prior art comprises four welding legs, wherein two of the welding legs are respectively connected with disconnected signal lines at the two ends (as shown in FIG. 1), and therefore, compared with the lamp bead in the prior art, the lamp bead 110 provided by the present disclosure has a simpler structure.

The positive electrode welding leg 111 is welded and fixed to the first connecting line 121, the negative electrode welding leg 112 is welded and fixed to the second connecting line 123, and the signal line welding leg 113 is welded and fixed to the signal line 122. The signal line 122 in the point-control copper wire lamp 100 provided in the embodiment of the present disclosure does not need to be disconnected and the lamp beads 110 can work normally, however, in the prior art, when the IC chip outputs signals, the signal line in the point-control copper wire lamp needs to be disconnected, or else the lamp beads in the point-control copper wire lamp cannot work normally.

Optionally, a plurality of lamp beads 110 are arranged sequentially at an interval along the extending direction of the signal line 122. The signal line 122 is an elongated threadlike wire, and the extending direction of the signal line 122 is the length direction of the signal line 122. The plurality of lamp beads 110 are arranged sequentially at an interval along the length direction of the signal line 122. Optionally, the plurality of lamp beads 110 are arranged at an equal interval, i.e., the distance between two adjacent lamp beads 110 is approximately equal to each other.

The lamp beads 110 connected in series can wind around each body to form various shapes.

Specifically, the model of the lamp beads 110 comprises 4040. It is understandable that the model of the lamp beads 110 may also comprise 3528, 5050, 5028 and 5640. The power of the lamp bead of the model 3528 comprises, but not limited to, 0.2 watt, the current comprises, but not limited to, 60 mA, and the voltage comprises, but not limited to, 3.5-5 V; the power of the lamp bead of the model 5050 comprises, but not limited to, 0.2 watt, the current comprises, but not limited to, 60 mA, and the voltage comprises, but not limited to, 3.5-5 V. Besides this, the models of LED lamp beads also comprise 3014, 4014, 5630 and the like.

Optionally, the point-control copper wire lamp also comprises an IC chip (not shown in the drawings), wherein the IC chip is packaged within the lamp beads; and the IC chip is connected with the signal line 122 via the signal line welding leg 113. Specifically, the IC chip is an integrated circuit (IC) chip.

Optionally, the point-control copper wire lamp 100 also comprises a controller 140. The controller 140 is connected with the lamp beads 110, and the controller 140 is configured to send control instructions to the IC chip in the lamp beads 110, so that the IC chip conducts the corresponding operation according to the control instructions.

Specifically, the controller 140 is electrically connected with the signal line 122, so as to send control instructions to the IC chip of the lamp beads 110 through the signal line 122.

Optionally, the first connecting line 121 and the second connecting line 123 are both connected with the controller 140.

Optionally, the control instructions comprise flash instructions. The controller 140 is configured to send the flash instructions to the IC chip, so that the IC chip controls the lamp beads 110 to flash according to the flash instructions.

Optionally, the control instructions comprise color display instructions. The controller 140 is configured to send the color display instructions to the IC chip, so that the IC chip controls the lamp beads 110 to display the corresponding colors according to the color display instructions.

Specifically, the controller 140 is configured to send control instructions to the IC chip; after receiving the control instructions sent by the controller 140, the IC chip controls the lamp beads 110 to execute the corresponding operations. In the above, the control instructions comprise, but not limited to, the flash instruction and the color display instruction.

For example, when the color display instruction is red, the IC chip controls the lamp beads 110 to display red. When the color display instruction is green, the IC chip controls the lamp beads to display green. When the color display instruction is yellow, the IC chip controls the lamp beads to display yellow.

Different lamp beads can also display different colors. For example, when the controller sends a color display instruction, which is red, to the first lamp bead 116, and sends a color display instruction, which is green, to the second lamp bead 117, then the first lamp bead 116 and the second lamp bead 117 respectively display red and green, thereby improving user's experience.

Optionally, the controller 140 is configured to select the lamp beads 110 according to the image to be displayed, and control the corresponding lamp beads 110 to flash according to the serial numbers of the selected lamp beads.

Specifically, the controller 140 selects lamp beads 110 needed by the image to be displayed according to the image to be displayed, wherein the lamp beads 110 that are selected are selected lamp beads 114, and the lamp beads 110 that are not selected are unselected lamp beads 115. At this moment, the selected lamp beads 114 have the corresponding series numbers, and then, the controller controls the selected lamp beads 114 according to the serial numbers. Optionally, the controller 140 may control the selected lamp beads 114 to flash, or control the selected lamp beads 114 to illuminate, while the other unselected lamp beads 115 are in an off state.

Figure 5:
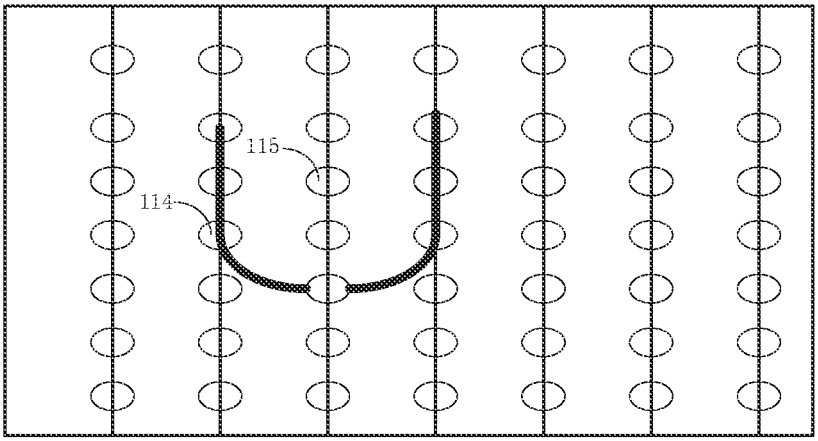
FIG. 5 is a schematic view showing that the lamp beads display the images to be displayed provided in the embodiment of the present disclosure.

FIG. 5 is a schematic view showing that the lamp beads display the images to be displayed provided in the embodiment of the present disclosure. Referring to FIG. 5, when the image to be displayed is a human face image, lamp beads that are needed for displaying the human face image are selected and serial numbers of the selected lamp beads 114 are obtained, the positions of the selected lamp beads 114 are determined based on the serial numbers of the selected lamp beads 114; and the selected lamp beads 114 are controlled to flash based on the positions and display the human face image.

Optionally, both the first connecting line 121 and the second connecting line 123 are copper wires. It is understandable that in other embodiments, threads of other materials may also be adopted.

Optionally, the first connecting line 121, the second connecting line 123 and the signal line 122 are arranged sequentially. Optionally, the first connecting line 121, the second connecting line 123 and the signal line 122 are arranged at the lamp beads 110 with an equal interval, i.e., the distance between the first connecting line 121 and the second connecting line 123 is approximately equal to the distance between the signal line 122 and the second connecting line 123.

Optionally, the point-control copper wire lamp 100 also comprises a power source 130, wherein the power source 130 is connected with the controller 140. Referring to FIG. 4, optionally, the power source 130 is located at the front end of the controller 140, and the lamp beads 110 are located at the rear end of the controller 140.

A lamp (not shown in the drawings) comprises the above-mentioned point-control copper wire lamp 100.

The embodiment of the present disclosure provides a point-control copper wire lamp 100 and a lamp, wherein the point-control copper wire lamp 100 comprises a plurality of lamp beads 110, a first connecting line 121, a signal line 122 and a second connecting line 123, wherein the lamp bead 110 comprises a positive electrode welding leg 111, a negative electrode welding leg 112 and a signal line welding leg 113. The positive electrode welding leg 111 is welded to the first connecting line 121, the negative electrode welding leg 112 is welded to the second connecting line 123, the signal line welding leg 113 is welded to the signal line 122, and the lamp beads 110 are arranged sequentially according to the preset positions. The point-control copper wire lamp 100 and the lamp provided by the embodiments of the present disclosure have simple structures, and the operation of each lamp bead 110 is independent and does not affect each other, thereby achieving a good effect in use.

A computer program product provided by the embodiments of the present disclosure, for example, the controlling program performed by the controller 140, comprises a computer readable storage medium stored with a program code, wherein the instructions comprised in the program code can be configured to execute the method in the preceding method embodiments, for the specific realizing method, references can be made to the method embodiment, and thus it is not repeated here.

It can be clearly understood by a person skilled in the art that, for convenient and brief description, reference can be made to the corresponding process in the above-mentioned method embodiment for the specific working process of the system and the device as described above, which thus are not repeated here.

In addition, in the description of the embodiments of the present disclosure, unless otherwise clearly specified and defined, terms "mount", "link" and "connect" should be understood in a broad sense, for example, it can be a fixed connection, a detachable connection, or an integral connection; it can be a mechanical connection or an electrical connection; it can be a direct connection or an indirect connection through an intermediate medium, and it can be the internal communication between two elements. For a person skilled in the art, they may understand the specific meaning of the above-mentioned terms in the present disclosure according to specific circumstances.

If the function is realized in a form of a software functional unit and sold and used as an independent product, it can be stored in a computer readable storage media. Based on such understanding, the technical solution of the present disclosure, or the part of the present disclosure making contribution to the prior art, or part of the technical solution can be embodied in the form of a software product, the computer software product is stored in a storage medium and comprises several instructions so that a computer equipment (it may be a person computer, a server, or a network equipment or the like) performs all or a portion of the steps of the method of each embodiment of the present disclosure. The abovementioned storage medium comprises mediums which can store program code such as a U-disc, a mobile hard disc, a read-only memory (ROM, Read-Only Memory), a random access memory (RAM, Random Access Memory), a diskette or a CD.

In the description of the present disclosure, it should be noted that the orientation or position relations indicated by the terms "center", "upper", "lower", "left", "right", "vertical", "horizontal", "inner", "outside" and the like are based on the orientation or position relations shown in the accompanying drawings, and they are just intended to conveniently describe the present disclosure and simplify the description, and are not intended to indicate or imply that the devices or elements as indicated should have specific orientations or should be configured and operated in specific orientations, and then should not be construed as limitations to the present disclosure. In addition, the terms "first", "second" and "third" are only intended for description and shall not be construed to indicate or imply relative importance.

Finally, it should be noted that the above-mentioned are merely some specific embodiments of the present disclosure to describe the technical solution of the present disclosure, and are not intended to limit the present disclosure, and the scope of the protection of the present disclosure is not limited by the above embodiments. Although the present disclosure is described in detail by the reference to the above-mentioned embodiments, a person skilled in the art should understand that any person commonly skilled in the art still can make modification to the technical solution disclosed in the above-mentioned embodiments or make any change easily conceived, or make equivalent substitutions to a portion of the technical features, within the technical scope disclosed in the present disclosure, while such modifications, changes or substitutions which do not make the corresponding technical solutions depart from the spirit and principle of the technical solution of the present disclosure should be covered within the scope of protection of the present disclosure. Therefore, the scope of protection of the present disclosure shall be based on the scope of protection of the claims.

INDUSTRIAL APPLICABILITY

To sum up, the present disclosure provides point-control copper wire lamp and lamp, which have simple structures, and the operation of each lamp bead is independent and does not affect each other, thereby achieving good effect in use.

What is claimed is:

1. A point-control copper wire lamp, comprising: a plurality of lamp beads, a first connecting line, a signal line and a second connecting line, wherein each of the lamp beads comprises a positive electrode welding leg, a negative electrode welding leg and a signal line welding leg, wherein the positive electrode welding leg is welded to the first connecting line, the negative electrode welding leg is welded to the second connecting line, the signal line welding leg is welded to the signal line, and the lamp beads are arranged sequentially according to preset positions, the point-control copper wire lamp further comprising an IC chip, wherein the IC chip is packaged within each of the lamp beads, and the IC chip is connected with the signal line via the signal line welding leg, the point-control copper wire lamp further comprising a controller, wherein the controller is connected with the lamp beads, and the controller is configured to send control instructions to the IC chip in the lamp beads, so that the IC chip executes corresponding operations according to the control instructions, and each of the lamp beads has a corresponding address distributed by a programmer.

2. The point-control copper wire lamp according to claim 1, wherein the controller is electrically connected with the signal line, so as to send the control instructions to the IC chip in the lamp beads via the signal line.

3. The point-control copper wire lamp according to claim 1, wherein both the first connecting line and the second connecting line are connected with the controller.

4. The point-control copper wire lamp according to claim 1, further comprising a power source, wherein the power source is connected with the controller.

5. The point-control copper wire lamp according to claim 4, wherein the power source is located at a front end of the controller, and the lamp beads are located at a rear end of the controller.

6. The point-control copper wire lamp according to claim 1, wherein the control instructions comprise flash instructions; and the controller is configured to send the flash instructions to the IC chip, so that the IC chip controls the lamp beads to flash according to the flash instructions.

7. The point-control copper wire lamp according to claim 1, wherein the control instructions comprise color display instructions; and the controller is configured to send the color display instructions to the IC chip, so that the IC chip controls the lamp beads to display corresponding colors according to the color display instructions.

8. The point-control copper wire lamp according to claim 1, wherein the controller is configured to select lamp beads according to an image to be displayed, and control corresponding lamp beads according to serial numbers of selected lamp beads.

9. The point-control copper wire lamp according to claim 1, wherein both the first connecting line and the second connecting line are copper wires.

10. The point-control copper wire lamp according to claim 1, wherein the first connecting line, the second connecting line and the signal line are arranged sequentially.

11. The point-control copper wire lamp according to claim 10, wherein the first connecting line, the second connecting line and the signal line are arranged at the lamp beads with an equal interval.

12. The point-control copper wire lamp according to claim 1, wherein the plurality of lamp beads are arranged sequentially at an interval along an extending direction of the signal line.

13. The point-control copper wire lamp according to claim 12, wherein the plurality of lamp beads are arranged at an equal interval.

14. The point-control copper wire lamp according to claim 1, wherein a model of the lamp beads is 4040.

15. The point-control copper wire lamp according to claim 1, wherein a model of the lamp beads is 5028.

16. The point-control copper wire lamp according to claim 1, wherein a model of the lamp beads is 5050 or 5640.

17. A lamp, comprising the point-control copper wire lamp according to claim 1.

* * * * *